US008616937B2

(12) United States Patent
Histed

(10) Patent No.: US 8,616,937 B2
(45) Date of Patent: Dec. 31, 2013

(54) RUNNING BASES

(76) Inventor: Jonathan R. Histed, Shoreham (GB)

( * ) Notice: Subject to any disclaimer, the term of this patent is extended or adjusted under 35 U.S.C. 154(b) by 178 days.

(21) Appl. No.: 12/736,777

(22) PCT Filed: May 7, 2009

(86) PCT No.: PCT/GB2009/050481
§ 371 (c)(1),
(2), (4) Date: Jan. 5, 2011

(87) PCT Pub. No.: WO2009/136203
PCT Pub. Date: Nov. 12, 2009

(65) Prior Publication Data

US 2011/0104436 A1 May 5, 2011

(30) Foreign Application Priority Data

May 9, 2008 (GB) ..... 0808434.5

(51) Int. Cl.
*B24B 1/00* (2006.01)

(52) U.S. Cl.
USPC ..... 451/57; 451/45

(58) Field of Classification Search
USPC ..... 451/36, 37, 38, 39, 40, 45, 57
See application file for complete search history.

(56) References Cited

U.S. PATENT DOCUMENTS

| | | | | |
|---|---|---|---|---|
| 5,492,037 | A * | 2/1996 | Graham | 26/83 |
| 5,582,535 | A * | 12/1996 | Friel | 451/45 |
| 6,267,652 | B1 * | 7/2001 | Friel et al. | 451/177 |
| 7,235,004 | B2 * | 6/2007 | Friel et al. | 451/198 |
| 2003/0148716 | A1 | 8/2003 | Lyons, III | |
| 2009/0233530 | A1 * | 9/2009 | Friel et al. | 451/45 |

* cited by examiner

*Primary Examiner* — Timothy V Eley
(74) *Attorney, Agent, or Firm* — Brooks, Cameron & Huebsch, PLLC

(57) ABSTRACT

The invention relates to running bases with improved speed and gliding characteristics when they run over water, snow or ice surfaces or artificial materials that mimic these surfaces. In particular the invention relates to a method comprising sequentially treating at least a portion of the running base with one or more abrasive materials having a progressively smaller particle size.

19 Claims, No Drawings

RUNNING BASES

This application is a National Stage application under 35 U.S.C. 371 of PCT/US2009/050481, filed on May 7, 2009 and published as WO 2009/136203 on Nov. 12, 2009, which claims priority in part from GB Application Serial No. 0808434.5 filed May 8, 2008, the entire content of which is incorporated herein by reference.

The present invention relates to a method of producing running bases with improved speed and gliding characteristics when they run over water, snow or ice surfaces or artificial materials that mimic these surfaces.

There are many examples of running bases for running over water, snow or ice and artificial materials which mimic these, including, for example all types of skis (including Telemark, Alpine, cross-country, mono skis and water skis), surf boards, snowboards, toboggans, bob sleighs, dog sleds, luge sleds, skidoos, all types of bladed ice skates and curling stones.

In the case of running over snow and ice surfaces, the glide experienced involves overcoming resistance that is caused by a combination of air resistance, displacement of the snow or ice (pushing the surface aside) and friction. However, current scientific theory holds that the situation regarding friction in snow and ice is complicated by the fact that as well as opposing and consequently limiting glide, the presence of friction is nevertheless indispensable for assisting in the formation of a very thin layer of melt water, which in turn provides boundary lubrication between the surface of the snow or ice and the surface of the running base. Thus, it has long been accepted that too smooth a running base, or a running base with too low a coefficient of friction, will cause insufficient melt water for hydrodynamic lubrication, and this will consequently lead to a decrease in the glide performance of the running base.

Manufacturers, well-equipped shops and service crews who sell or handle equipment with running bases of the types described above, typically make a running base smooth by either using grinding machines with abrasive grinding wheels, a wet-belt sander, or, in the case of some running bases such as skis and snowboards, by scraping with a sharp scraper followed by sanding with an 180 Grit (average particle size 78 microns) bonded abrasive and buffing with a nylon pad. These smoothing operations will provide the running base with a surface that has a series of fine longitudinally aligned grooves which apparently generate sufficient friction, and therefore sufficient melt water, to allow the running base to be hydrodynamically lubricated. In the case of skis and snowboards especially, a further rilling operation is also commonly used to produce deeper grooved structuring or rills. For Alpine skis, Telemark skis and snowboards, these rills can be made using a bronze or steel brush or 100 Grit (average particle size 156 microns) bonded adhesive, and for cross-country skis, one uses a rilling iron or a dressed grinding wheel. Typical rilling irons and dressed grinding wheels form grooves that are between 0.25 mm and 0.52 mm deep. The structured surface can either be formed uniformly along the whole length of the ski or board or, as described in U.S. Pat. No. 5,725,237, be concentrated in the rear portion of the ski or board. The purpose of these rills is to promote removal of the melt water so as to prevent suction phenomena that also resist gliding, and also to provide extra grip in the case of cross-country skis. A variety of rilling patterns are used, for example longitudinal lines and diamond shaped marks and theories abound as to which pattern provides the greatest advantages. When the weather temperature is lower than −4° C., snow becomes dryer, more abrasive and harder, and under these conditions finer smoothing of the running base is recommended. 340 Grit bonded abrasive is regularly used for conditions at −20° C. and experts in the field of preparing race skis recommend using 1000 Grit diamond bonded abrasive material to obtain a "super smooth finish". However, it is generally acknowledged that sanding of the running base any finer than this will compromise hydrodynamic lubrication.

It is worth pointing out that graded diamond stones are also used to optimise the metal edges of skis and snowboards. For example, a coarse 100 grit diamond stone may be used to quickly remove the hard edge burrs that result for example from rock damage or following the use of bastard files; a 325 grit diamond stone may be used for routine edge maintenance; a 600 grit diamond stone for deburring and edge polishing and a 1200 grit stone for ultra smooth edge polishing. There is not known to practice ultra smooth polishing on the running base of the ski as distinct from the metal edges, since, as mentioned above, this would compromise hydrodynamic lubrication.

Although the above techniques are commonplace, it is difficult to ensure that the running base is completely flat, and this is essential for optimised running speed and glide. The back and forth motion of grinding and sanding can cause some portions of the running base to be more ground or sanded than others and this produces high and low points or a transverse ripple pattern at regular intervals along the base. Innovations in grinding and sanding technology have recently helped to reduce this problem but success relies heavily on the skill of the person operating the grinder or sander.

Whilst the known methods for sanding and altering the surface structure of a running base as discussed above do affect glide performance, we have found that still further significant improvements can be achieved using a new and hitherto undisclosed method. Moreover, our method is completely surprising in the light of the current scientific theory that explains how hydrodynamic lubrication occurs. In addition, our method is advantageous over a wide range of temperature conditions and is particularly advantageous at temperatures of −4° C. and below. The present invention provides further benefits by significantly reducing and in most cases substantially eliminating the problem of transverse ripples being formed on the running base. Yet further advantages of the present invention are described below.

Ice-skating takes several different forms but there are two main skating styles popular today: ice hockey and figure skating. Typical figure and hockey skate blades (the "running base") are made of tempered steel, coated with high quality chrome, and the blades are about 4 mm thick and may have a slightly tapered cross-section. Viewed from the side, these blades are not flat but slightly curved, front to back, with a radius of curvature of about 2 m. The curvature must be smooth as it is this feature which allows the skates to turn freely on the ice, and the greater the degree of curvature, the easier it will be for the skater to turn, but the skate will be less stable front to back. To compensate for this loss of grip, the blade is also "hollow ground": a curved groove is ground into it using a spinning abrasive wheel which has been dressed so it forms part of a circle, the radius of which is known as the "radius of hollow". As one might imagine, being rough, the abrasive wheel produces scratches or striations on the inside surface of the hollow which are visible to the naked eye; it is these which are believed to contribute to the generation of friction for dynamic lubrication. The groove also creates on each blade two distinct edges, inside and outside, which serve to bite into the ice. Over time, the blade will become blunted and wear unevenly, consequently it will be necessary for the blades to be professionally reground and sharpened using a spinning abrasive wheel, to correct the front to back radius of curvature and the radius of hollow.

In a first embodiment, the present invention provides a method of producing a running base with improved running speed and glide characteristics over snow, ice or water, and any artificial surface that mimics these surfaces, comprising a first step in which at least one portion of the running base is sequentially treated with one or more abrasive materials having a progressively smaller particle size, wherein the final abrasive material in the first step is finer than 1000 Grit. The present invention may also comprise an optional second step in which the at least one portion of the running base is sequentially treated with one or more lapping abrasive materials having a progressively smaller particle size, wherein the final lapping abrasive material in the second step has a particle size of 40 microns or less.

Preferably the final abrasive material used in the first step is finer than 1200 Grit, further preferably 2000 Grit or finer is used. The final lapping abrasive used the second step preferably has a particle size of 30 microns or less, further preferably 10 microns or less. A lapping abrasive material with a particle size of 0.0001 microns is preferred and especially preferred is the use of a final lapping abrasive material with a particle size in the range 0.05 and 0.01 microns.

Preferably in the first embodiment two or more abrasive materials are used in the first step and two or more lapping abrasive materials are used in the second step.

In this application, "abrasive material", whether explicitly or implicitly referred to, is to be interpreted as a generic term that refers to bonded, coated and lapping abrasive material and includes abrasive materials carried for example in gels, liquids, powers and slurries.

The term "bonded abrasive material" is generally used to describe abrasive material, most usually aluminium oxide, within a matrix such as clay, resin, glass or rubber. The term "coated abrasive material" is used to describe silicon dioxide coated on a backing material such as paper, cloth, rubber etc. Although the average particle size is often quoted for both of these products to provide a guide as to the coarseness of bonded and coated abrasive, it is found that the actual distribution of particle sizes, i.e. the difference between the maximum and the minimum particle size, is very large. By contrast lapping abrasives, typically used for honing and fine polishing optical equipment and gem stones, are known for their extreme performance tolerances due to the extremely low particle size distribution of the abrasive particles. As a consequence of this we have found that it is beneficial to follow treating a running surface with a 2000 Grit abrasive material (which has an average particle size of 12 microns), with a 40 micron lapping abrasive because the latter will smooth out the lines made by the larger particles found in the 2000 Grit material. Any lapping abrasive material may be used, however, we have found it extremely convenient to use lapping films which comprise tightly graded mineral particles coated on a plastic (e.g. polyester) film. Suitable lapping films are available from the company 3M™.

We have found that it is possible to achieve the benefits of using a lapping abrasive material without performing the first step using an abrasive material of finer than 1000 Grit.

Thus, in a second embodiment, the present invention provides the method of producing a running base with improved running speed and glide characteristics over snow, ice or water, and any artificial surface that mimics these surfaces, comprising sequentially treating at least one portion of the running base with one or more lapping abrasive materials having a progressively smaller particle size, wherein the final lapping abrasive material has a particle size of 40 microns or less. Preferably the final lapping abrasive has a particle size of 30 microns or less, further preferably 10 microns or less, and a final lapping abrasive particle size of 0.0001 microns is especially preferred. Significant advantages are achieved when the final lapping abrasive material has a particle size in the range 0.05 and 0.01 microns. Further preferably two or more lapping abrasive materials may be used.

Treatment of the running base with the one or more abrasive materials may be under dry conditions, although it is preferable to use a cutting fluid. Any suitable fluid may be used such as water or water mixed with an additive such as a detergent, lubricant, coolant or antioxidant. Preferably, the running base is cleaned, for example with water or by wiping with a cloth, before treatment with the next abrasive material in the sequence.

The method of the present invention can be further improved by using a reference surface in conjunction with the abrasive material, which reference surface is preferably profiled to correspond with the desired profile of the running base. It is envisaged that the abrasive material is either fixedly bonded in some way to the reference surface or the abrasive material is removably fixed to it so that one abrasive material may be interchanged with the next as the method of the present invention is performed. The present invention may be performed in any convenient way such as manually or using a mechanically operated tool, powered for example, electrically, by clockwork, pneumatically, hydraulically or by any other source of mechanical power.

The method of the present invention may be performed over the whole surface of the running base or over one or more portions of it and it is not necessary that all portions are treated with the same sequence of abrasive materials or that the same final abrasive material is used on all portions. In the case of skis and snowboards, and other running bases with metal edges, it is preferable that the metal edges adjacent the treated portions of the running base are also treated in accordance with the method of the present invention. It is also advantageous that the metal edges are treated separately from the running base using an abrasive material of less than 1200 Grit and preferably less than 1500 Grit.

It will be appreciated that the method of the present invention serves to provide a running base having a very uniform micro surface topography in which the difference between the peaks and troughs at this level are of the same order as the abrasive material being used. Preferably this is of the order of a few microns and preferably less than 1 micron. As explained above, in some applications it is advantageous if the movement of the melt water relative to the base is controlled so as to prevent the suction phenomena as described above. Consequently, the method of the present invention may also include the further optional step of adding specific defined structuring to the running base, such as that introduced by rilling. A conventionally smoothed running base that has been rilled produces a very complex surface topography due to a combination of the peaks and troughs caused by the relatively coarse sanding or grinding with the additional rill structuring on top. As the running base is used, these peaks are slowly abraded by the action of the water, snow or ice and it is necessary to re-sand and re-rill the running surface frequently to maintain good speed and glide; this is particularly acute at temperatures of −4° C. or above (e.g. snow conditions in Spring). By contrast, because a running base smoothed by the method of the present invention does not have the peaks caused by coarse sanding, wear on the base is much less and as a result, less frequent sanding and grinding is necessary. In addition, when structure is added to a running base smoothed by the method of the present invention, the surface topography looks to be a series of very accurately defined grooves that extend into the body of the running base, and which are separated by extremely flat areas of the surface of the base. Since these flat areas only wear slowly, the cut rills are left intact for longer and frequent re-rilling is also unnecessary. It is also possible for the running base to be rilled prior to or simultaneously with smoothing using the method of the present invention. A variety of rilling patterns may be used and these may either be formed over some of or the entire running base.

The method of the present invention can be applied to all types of running bases including for example all types of skis (including Telemark, Alpine, cross-country, mono skis and water skis), surfboards, snowboards, ski bikes, toboggans, bob sleighs, dog sleds, luge sleds, skidoos, all types of bladed ice skates and curling stones.

In the case of hollow ground skates, such as used in figure skating and ice hockey, the method of the invention is advantageously practiced to firstly minimise, and preferably to essentially eliminate, the scratches or striations caused by the abrasive grinding wheel during the formation of the hollow feature in the blade, and secondly to optimise the sharpness of the blade edges. Skates prepared by the method of the present invention, not only benefit from a significantly enhanced gliding surface that allows greater distances to be traveled for the same effort, but also an edge sharpness that controls sideways forces. Additionally, further beneficial improvements regarding control and precision are also obtained. All of these improvements are totally unexpected in the light of present scientific explanation regarding how skates slide on ice: all current thinking believes that the striations in the hollow are essential to producing sufficient friction for hydrodynamic lubrication, the factor that makes ice slippery. Moreover, the Applicant has observed further significant advantages may be gained by using the method of the present invention. As described above, the present invention ensures that the edges and hollow of the skate are sharpened and polished far beyond the levels achievable using conventional techniques, as a result of this enhanced polishing the applicant has observed that both the hollow remains true and polished and the edges remain sharp for much longer than is the case for a conventionally-polished blade. Thus, the improved glide performance and the other advantages mentioned above, for a blade polished by the method of the invention, are maintained for a lot longer than might be expected. This finding is again unexpected since, if anything, one would expect that a finely sharpened skate edge would be inherently weaker and more susceptible to damage than the conventionally ground edge, whereas the opposite has been observed. As a consequence, the frequency of re-grinding is reduced and since skate blades cannot be re-ground an infinite number of times, it is expected that their life expectancy will be dramatically improved.

The present invention will now be more particularly described, with reference to the following examples.

EXAMPLE 1

Improved Glide Performance of Ice Skate Blades—Manual Application of Abrasives The ice skates used in the tests was a pair of 10-inch John Wilson Parabolic pattern 99 figure skating blades with a K-Pick, with a 7/16 inch radius of hollow, mounted on Risport boots. Both blades were prepared using the method of the present invention by rubbing back and forth along the length of the relieved part of the blade and the hollow with a series of progressively finer abrasive materials. Water was used as the cutting fluid, and the blade was cleaned between abrasive grades. After treatment with each grade of abrasive, the blades were washed with water to remove debris that would interfere with the subsequent finer abrasive material. The ice rink used was of an Olympic size.

The Sequence of Abrasives Used to Prepare the Skates

| Abrasive | Notes |
|---|---|
| 3 m 400 Grit Wet and Dry | 2 rounds |
| 3 m 800 Grit Wet and Dry | 1 round |
| 3 m 1000 Grit Wet and Dry | 1 round |
| 3 m 1200 Grit Wet and Dry | 1 round |
| 3 m 2000 Grit Wet and Dry | 1 round |
| 3 m 30μ lapping film | 2 rounds |
| 3 m 15μ lapping film | 2 rounds |
| 3 m 9μ lapping film | 1 round |
| 3 m 5μ lapping film | 1 round |
| 3 m 3μ lapping film | 1 round |
| 3 m 1μ lapping film | 1 round |
| 3 m 0.3μ lapping film | 1 round |
| 3 m 0.05μ lapping film | 2 rounds final polish |

[1 round = 5 passes along the blade and hollow]

Results

The skates prepared as described above were tested by an elite level male figure skater (age 27, height 5'7", weight 140 lbs) who gave one standardised push from one side of the ice rink and maintained the resulting glide for as long as possible. The standardised push was sufficiently consistent to propel the skater to within +/−30 cm, thus reproducibility of the results was ensured. The glide distance for the skates before treatment using the above series of abrasive materials was measured to be 0.75 times the length of the ice rink, whereas the glide distance achieved after preparation of the blades as described above achieved 1.5 lengths of the ice rink. This improvement suggests a significant reduction in the coefficient of friction and a commensurate improvement in gliding performance.

EXAMPLE 2

Improved Glide Performance of Ice Skate Blades—Application of Abrasives Using Hand-Held Electro-Mechanical Tool The ice skates used in Example 2 were the same as those described for Example 1. Before the start of Example 2, the blades were re-ground using conventional techniques (tested as control). One of the blades was then prepared using a cumulative series of progressively finer abrasive materials. Testing, as described below, was carried out after application of each of the abrasive materials. The abrasive materials were in sheet form and mounted on the outside surface of a solid plastic tubular mandrel, 50 mm long, located within a hand-held battery powered tool. Using a low power DC motor, the mandrel was actuated to reciprocate longitudinally and simulate the manual back and forth motion used in Example 1. In each case, the abrasive material was applied for 2 minutes along the length of the relieved part of the blade and the hollow. The abrading in Example 2 was carried out dry, i.e. without a cutting fluid, and the blade was wiped with a cloth between abrasive grades.

Sequence of Abrasives Used

| Polishing regime (PR) | Abrasive Sequence |
|---|---|
| 1) | Control (re-ground using conventional techniques) |
| 2) | PR 1) + 180 grit Wet and Dry |
| 3) | PR 2) + 800 grit Wet and Dry |
| 4) | PR 3) + 5μ lapping film |
| 5) | PR 4) + 1_μ lapping film |
| 6) | PR 5) + 0.3μ lapping film |
| 7) | PR 6) + 0.05μ lapping film |

Results

One of the skates was prepared according to polishing regimes 1-7 above and testing was carried out with the same elite level male figure skater as used in Example 1. The other skate was maintained as a control throughout. In each experiment, the skater gave one standardised push on the prepared skate from one side of the ice rink and maintained the resulting glide for as long as possible. The standardised push was sufficiently consistent to propel the skater to within +/−30 cm, thus reproducibility of the results was ensured. The glide distance of the skates prepared using the above series polishing regimes was measured in meters and the results presented below are an average of three results.

| Polishing Regime | Glide Distance (m) |
|---|---|
| 1) (Control) | 20 |
| 2) | 25 |
| 3) | 23 |
| 4) | 34 |
| 5) | 42 |
| 6) | 58 |
| 7) | 70 |

The above results clearly demonstrate that polishing the blade edges and hollow following the method of the present invention produces a dramatic increase in the glide distance.

EXAMPLE 3

Qualitative Observations by the Elite Level Skater on the Benefits Pained Using the Method of the Present Invention on Ice Skates (Manually Applied Abrasive)

The elite level skater was asked to consider the sensation of skating on a newly re-ground skate (his right skate) and compare it against the sensation of skating on a blade prepared using the method of the present invention (his left skate). The skates used were a pair of 10-inch John Wilson Parabolic pattern 99 figure skating blades with a K-Pick, with a 7/16 inch radius of hollow, mounted on Risport boots. Both skates were re-ground using conventional techniques before testing. The right skate was left unpolished throughout (the control) and the left skate was polished using a cumulative sequence of abrasives as detailed below. The skater was asked to consider his right skate as "50" on a scale of 1-100, (0=bad; 100=amazing) to set a reference for comparison with the skates polished using the manual technique described in Example 1 and according to polishing regimes 8) to 12) below.

| Polishing Regime | Abrasive Sequence |
|---|---|
| 8) | Control (re-ground using conventional techniques) |
| 9) | 400 grit Wet and Dry (200 passes) |
| 10) | 9) + 800 grit Wet and Dry (200 passes) |
| 11) | 10) + 12μ lapping film (200 passes) |
| 12) | 11) + 5μ lapping film (100 passes) |

| | Polishing Regime | | | | |
|---|---|---|---|---|---|
| Skater's comments | 8) | 9) | 10) | 11) | 12) |
| Overall impression | 50 | 60 | 85 | 60 | 95 |
| Smoothness | 50 | 90 | 95 | 90 | 100 |
| Ease of Glide | 50 | 90 | 100 | 90 | 100 |
| Controllability | 50 | 70 | 85 | 85 | 95 |
| Confidence | 50 | 80 | 90 | 80 | 100 |
| Comfort | 50 | 90 | 90 | 75 | 100 |
| Responsiveness | 50 | 80 | 95 | 80 | 95 |
| Power | 50 | 80 | 90 | 100 | 95 |
| Balance | 50 | 75 | 90 | 85 | 95 |

Clearly dramatic benefits to ice skates can be gained by using the method of the present invention.

EXAMPLE 4

Qualitative Observations by the Elite Level Skater on the Benefits Gained Using the Method of the Present Invention on Ice Skates—Abrasives Applied Using Electro-Mechanical Tool The ice skates used in Example 4 were the same as those described for Example 2. The blades were re-ground using conventional techniques (tested as control). One of the blades was then prepared using a cumulative series of progressively finer abrasive materials. Testing, as described below, was carried out after application of each of the abrasive materials. The abrasive materials were in sheet form and mounted on the outside surface of a solid plastic tubular mandrel, 50 mm long, located within a hand-held battery powered tool. Using a low power DC motor, the mandrel was actuated to reciprocate longitudinally and simulate the manual back and forth motion used in Example 1. In each case, the abrasive material was applied for 2 minutes along the length of the relieved part of the blade and the hollow. The abrading in Example 4 was carried out dry, i.e. without a cutting fluid, and the blade was wiped with a cloth between abrasive grades.

| Polishing Regime | Abrasive sequence |
|---|---|
| 13) | Control (re-ground using conventional techniques) |
| 14) | 13) + 180 grit Wet and Dry |
| 15) | 14) + 800 grit Wet and Dry |
| 16) | 15) + 5μ lapping film |
| 17) | 16) + 1μ lapping film |
| 18) | 17) + 0.3μ lapping film |

| Skater's comments | Polishing Regime 13) | 14) | 15) | 16) | 17) | 18) |
|---|---|---|---|---|---|---|
| Overall impression | 50 | 70 | 50 | 75 | 80 | 93 |
| Smoothness | 50 | 85 | 60 | 70 | 90 | 97 |
| Ease of Glide | 50 | 80 | 45 | 85 | 92 | 94 |
| Controllability | 50 | 80 | 55 | 85 | 89 | 95 |
| Forward travel | 50 | 75 | 45 | 80 | 90 | 98 |
| Responsiveness | 50 | 85 | 75 | 87 | 90 | 95 |
| Power | 50 | 85 | 60 | 89 | 90 | 93 |
| Bite | 50 | 60 | 60 | 68 | 88 | 90 |

Again, the above results demonstrate the advantages of the present invention.

The invention claimed is:

1. A method of polishing a running base to provide improved running speed and glide characteristics over snow, ice or water, and any artificial surface that mimics snow, ice, or water, comprising a first step in which at least one portion of the running base is sequentially treated with two or more abrasive materials having a progressively smaller particle size wherein the final abrasive material in the first step is finer than 1000 Grit.

2. A method of polishing a running base according to claim 1 including a second step in which at least one portion of the running base is sequentially treated with two or more lapping abrasive materials having a progressively smaller particle size, wherein the final lapping abrasive material in the second step has a particle size of 40 microns or less.

3. A method according to claim 2, wherein sequentially treating with the two or more abrasive materials comprises treating by applying a cartridge including the two or more abrasive materials and wherein sequentially treating with the two or more lapping abrasive materials comprises treating by applying a cartridge including the two or more lapping abrasive materials.

4. A method according to claim 3, wherein the cartridge including the two or more abrasive materials and the cartridge including the two or more lapping abrasive materials further include a reference surface profiled to correspond with a desired profile of the running base.

5. A method according to claim 4, wherein the abrasive material and the lapping abrasive material are removably fixed to the reference surface of their respective cartridge.

6. A method according to claim 1 wherein the abrasive material is finer than 1200 Grit.

7. A method according to claim 6 wherein the abrasive material is finer than 2000 Grit.

8. A method according to claim 1 including a second step in which at least one portion of the running base is sequentially treated with two or more lapping abrasive materials having a progressively smaller particle size, wherein the final lapping abrasive has a particle size of 30 microns or less.

9. A method according to claim 1 including a second step in which at least one portion of the running base is sequentially treated with two or more lapping abrasive materials having a progressively smaller particle size, wherein final lapping abrasive has a particle size of 0.0001 microns.

10. A method according to claim 1 wherein a cutting fluid is applied to the running base during the sequential treatment.

11. A method according to claim 1 wherein treatment with the final abrasive material is preceded, carried out simultaneously or followed by adding defined structuring to one or more portions of the running base.

12. A method according to claim 1 wherein the running base is selected from skis, surf boards, snowboards, toboggans, bob sleighs, dog sleds, luge sleds, skidoos, snow bikes, all types of bladed ice skates and curling stones.

13. A method according to claim 12 wherein the running base is selected from skis, snowboards and ice skates comprising a hollow ground blade.

14. A method according to claim 13 wherein the abrasive materials are used in the sequence: a 5 micron lapping abrasive material, then a 1 micron lapping abrasive material, then a 0.3 micron lapping abrasive material, and then a 0.05 micron lapping abrasive material.

15. A method according to claim 1 wherein the polishing includes polishing at least one of a hollow and an edge of an ice skate blade.

16. A method according to claim 15, wherein the abrasive materials are used in the sequence: a 180 Grit abrasive material, then a 800 Grit abrasive material, then a 5 micron lapping abrasive material, and then a 1 micron lapping abrasive material.

17. A method according to claim 1 wherein the polishing includes polishing at least one of a running base of skis and an edge of a ski.

18. A method according to claim 1, wherein the method includes sequentially treating at least a portion of the running base with a number of the abrasive materials having a 400 Grit particle size, a 800 Grit particle size, a 1000 Grit particle size, a 1200 Grit particle size, and a 2000 Grit particle size; and sequentially treating at least a portion of the running base with a number of lapping abrasive materials having a 30μ particle size, a 15μ particle size, a 9μ particle size, a 5μ particle size, 3μ particle size, a 1μ particle size, a 0.3μ particle size, and a 0.05μ particle size.

19. A method of polishing a running base to provide improved running speed and glide characteristics over snow, ice or water, and any artificial surface that mimics snow, ice, or water, comprising sequentially treating at least one portion of the running base with two or more lapping abrasive materials having a progressively smaller particle size, wherein the final lapping abrasive material has a particle size of 40 microns or less.

* * * * *

UNITED STATES PATENT AND TRADEMARK OFFICE

CERTIFICATE OF CORRECTION

PATENT NO. : 8,616,937 B2
APPLICATION NO. : 12/736777
DATED : December 31, 2013
INVENTOR(S) : Jonathan R. Histed It is certified that error appears in the above-identified patent and that said Letters Patent is hereby corrected as shown below:

In the Specification

In column 1, line 2, delete "PCT/US2009/050481" and insert --PCT/GB2009/050481--, therefor.

Signed and Sealed this
Seventeenth Day of June, 2014

Michelle K. Lee

Michelle K. Lee
*Deputy Director of the United States Patent and Trademark Office*